US007451978B2

(12) United States Patent
Masotta

(10) Patent No.: US 7,451,978 B2
(45) Date of Patent: Nov. 18, 2008

(54) CONTINUOUSLY ADJUSTABLE PAPER PATH GUIDE DECK

(75) Inventor: John R. Masotta, Bethel, CT (US)

(73) Assignee: Pitney Bowes Inc., Stamford, CT (US)

( * ) Notice: Subject to any disclaimer, the term of this patent is extended or adjusted under 35 U.S.C. 154(b) by 435 days.

(21) Appl. No.: 10/938,814

(22) Filed: Sep. 10, 2004

(65) Prior Publication Data

US 2006/0055103 A1 Mar. 16, 2006

(51) Int. Cl.
*B65H 29/34* (2006.01)

(52) U.S. Cl. ..... 271/189; 271/207; 271/3.03; 271/3.14; 270/58.01

(58) Field of Classification Search ..... 271/189, 271/190, 191, 192, 198, 220, 223, 224, 275, 271/199, 3.14, 3.03, 265.01, 245; 414/789.9–790.8; 270/58.01, 52.01, 52.02; 198/418.3, 419.1
See application file for complete search history.

(56) References Cited

U.S. PATENT DOCUMENTS

| | | | | |
|---|---|---|---|---|
| 3,206,191 | A | 9/1965 | Handscho | |
| 3,284,081 | A | 11/1966 | Huck | |
| 3,542,362 | A | 11/1970 | Brockmuller et al. | |
| 3,815,897 | A | 6/1974 | Hoe et al. | |
| 3,908,527 | A | 9/1975 | Brockmuller et al. | |
| 4,046,259 | A | 9/1977 | Dunlap | |
| 4,078,790 | A | 3/1978 | Stocker | |
| 4,223,882 | A | 9/1980 | Stocker | |
| 4,431,322 | A | 2/1984 | Nally et al. | |
| 4,518,161 | A | 5/1985 | Nakamura | |
| 4,602,776 | A | 7/1986 | York et al. | |
| 4,640,506 | A * | 2/1987 | Luperti et al. | 271/212 |

(Continued)

FOREIGN PATENT DOCUMENTS

| | | |
|---|---|---|
| DE | 2559281 A1 | 7/1977 |
| GB | 1445913 | 8/1976 |

OTHER PUBLICATIONS

Definition of "deck". American Heritage Dictionary of the English Language, 4th Ed. Houghton Mifflin, 2000 [cited Mar. 17, 2007]. Available from http://www.bartleby.com.*

*Primary Examiner*—Patrick Mackey
*Assistant Examiner*—Jeremy Severson
(74) *Attorney, Agent, or Firm*—Christopher H. Kirkman; Steven J. Shapiro; Angelo N. Chaclas

(57) ABSTRACT

A guide deck for use with a sheet processing device having a paper path. The adjustable paper path guide deck apparatus includes a first roller proximal the input end and a second roller proximal to the output end. These rollers support a flexible sheet of non-permanently deforming material wrapped around them. The surface of the sheet forms a guide deck for the paper path. To adjust for different sized sheets, the guide deck is movable along a paper path direction while moving around the first and second rollers. A locking mechanism is coupled to the adjustable paper path guide deck apparatus for preventing the flexible sheet from moving around the first and second rollers when in a locked position, and allowing movement around the first and second rollers when in an unlocked position.

18 Claims, 5 Drawing Sheets

U.S. PATENT DOCUMENTS 4,729,282 A 3/1988 Kasdorf
4,732,261 A 3/1988 Mattern et al.
4,799,633 A 1/1989 Golicz
4,799,663 A * 1/1989 Golicz ..... 271/199
4,805,891 A * 2/1989 Luperti et al. ..... 271/212
4,925,180 A 5/1990 Goliez
4,989,854 A * 2/1991 McNamara ..... 271/213
5,083,769 A 1/1992 Young, Jr.
5,123,639 A * 6/1992 Edwards ..... 271/212
5,147,092 A * 9/1992 Driscoll et al. ..... 271/184
5,178,379 A 1/1993 Edwards et al.
5,326,088 A * 7/1994 Newsome ..... 271/3.23
5,484,255 A 1/1996 Lowell et al.
5,536,136 A * 7/1996 Mason ..... 198/750.8
5,570,775 A * 11/1996 Kleinhans et al. ..... 198/635
5,711,649 A * 1/1998 Gerlier ..... 414/790.7
6,695,135 B1 * 2/2004 Lapeyre ..... 198/853
6,776,409 B2 * 8/2004 Cook ..... 271/189
6,786,325 B2 * 9/2004 Powell ..... 198/807
6,796,558 B1 * 9/2004 Dorer ..... 271/189

* cited by examiner

CONTINUOUSLY ADJUSTABLE PAPER PATH GUIDE DECK

TECHNICAL FIELD

The present invention relates to an adjustable guide deck for use in a high speed paper feeding and processing apparatus, such as a sheet accumulator.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 100. The continuous web must be separated into individual document pages. This separation is typically carried out by a web cutter 200 that cuts the continuous web into individual document pages. Depending on the mail run specifications, the cutter 200 can be set to cut sheets of different sizes. For example, some mailings may require letter size sheets, while others might include legal sized pages, or smaller than letter sized pages. Downstream of the web cutter 200, a right angle turn 300 may be used to reorient the documents, and/or to meet the inserter user's floor space requirements.

The cut pages must subsequently be accumulated into collations corresponding to the multi-page documents to be included in individual mail pieces. This gathering of related document pages occurs in the accumulator module 400 where individual pages are stacked on top of one another.

The control system for the inserter senses markings on the individual pages to determine what pages are to be collated together in the accumulator module 400. In a typical inserter application, mail pieces may include varying number of pages to be accumulated. When a document accumulation is complete, then the accumulation is discharged as a unit from the accumulator 400. An accumulator module 400 should also be adjustable so that it is capable of handling sheet accumulations of different sizes.

A conventional accumulator module 400 is described in U.S. Pat. No. 5,083,769 to Young, which is hereby incorporated by reference in its entirety. While this conventional accumulator has been found to operate successfully in transporting paper sheets at up to 150 inches per second (ips), it has been found to become unstable at higher speeds, such as 300 ips. Also, the conventional accumulator has been successful at accumulating sets of documents having on the order of eight sheets. However for improved processing capabilities it has become desirable to collate as many as twenty sheets.

Downstream of the accumulator 400, a folder 500 typically folds the accumulation of documents to fit in the desired envelopes. To allow the same inserter system to be used with different sized mailings, the folder 500 can typically be adjusted to make different sized folds on different sized paper. As a result, an inserter system must be capable of handling different lengths of accumulated and folded documents.

Downstream of the folder 500, a buffer transport 600 transports and stores accumulated and folded documents in series in preparation for transferring the documents to the synchronous inserter chassis 700. By lining up a backlog of documents in the buffer 600, the asynchronous nature of the upstream accumulator 400 will have less impact on the synchronous inserter chassis 700. On the inserter chassis 700 inserts are added to the folded accumulation prior to insertion into an envelope at a later module.

SUMMARY OF THE INVENTION

While the prior art accumulator described above often performs satisfactorily at speeds in the range of 150 ips, it has been found that at higher speeds, such as 300 ips, paper sheets will flutter and be damaged. Accordingly, the present invention provides a paper path guide deck that operates more reliably at the desired higher speeds, and is easily adjustable for different sized sheets of paper. The adjustable sheet deck also provides a single, smooth, uninterrupted surface that will not interfere with high speed feeding of paper pages.

While the preferred embodiment is used with a sheet accumulator, the invention may be used in connection with any kind of paper processing device having a paper path and guide deck. In the preferred embodiment, the adjustable paper path guide deck apparatus includes a first roller proximal the input end and a second roller proximal to the output end. These rollers support a flexible sheet of non-permanently deforming material wrapped around them. The surface of the sheet forms a guide deck for the paper path.

To adjust for different sized sheets, the guide deck is movable back and forth along a paper path direction while moving around the first and second rollers. A locking mechanism is coupled to the adjustable paper path guide deck apparatus for preventing the flexible sheet from moving around the first and second rollers when in a locked position, and allowing movement around the first and second rollers when in an unlocked position.

In the preferred embodiment, a sheet-manipulating device is coupled to the flexible sheet and operates on sheets transported in the paper path. A position of the sheet-manipulating device between the input end and the output end of the paper path is adjustable by moving the flexible sheet around the first and second rollers. For the preferred embodiment of an accumulator, the sheet-manipulating device is a ramp that is used to stack sheets on top of one another downstream of the ramp.

Further details of the present invention are provided in the accompanying drawings, detailed description and claims.

DETAILED DESCRIPTION

Figure 1:
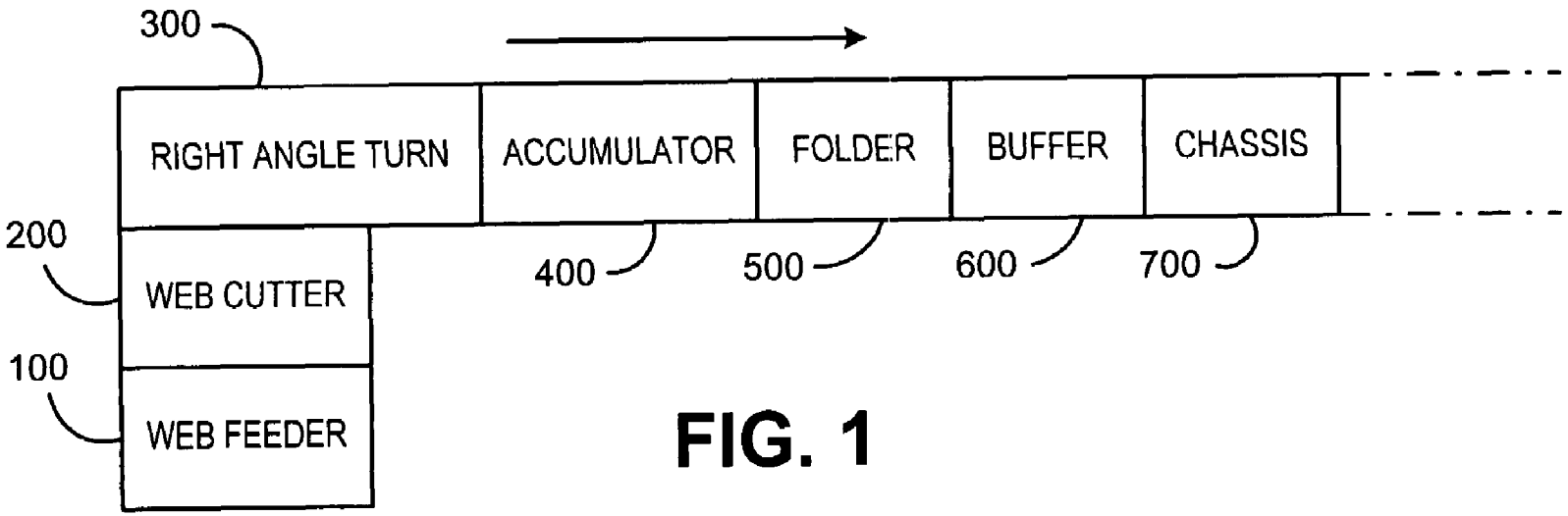
FIG. 1 is a diagram of the input stages of an inserter system for use with the present invention.
Figure 2:
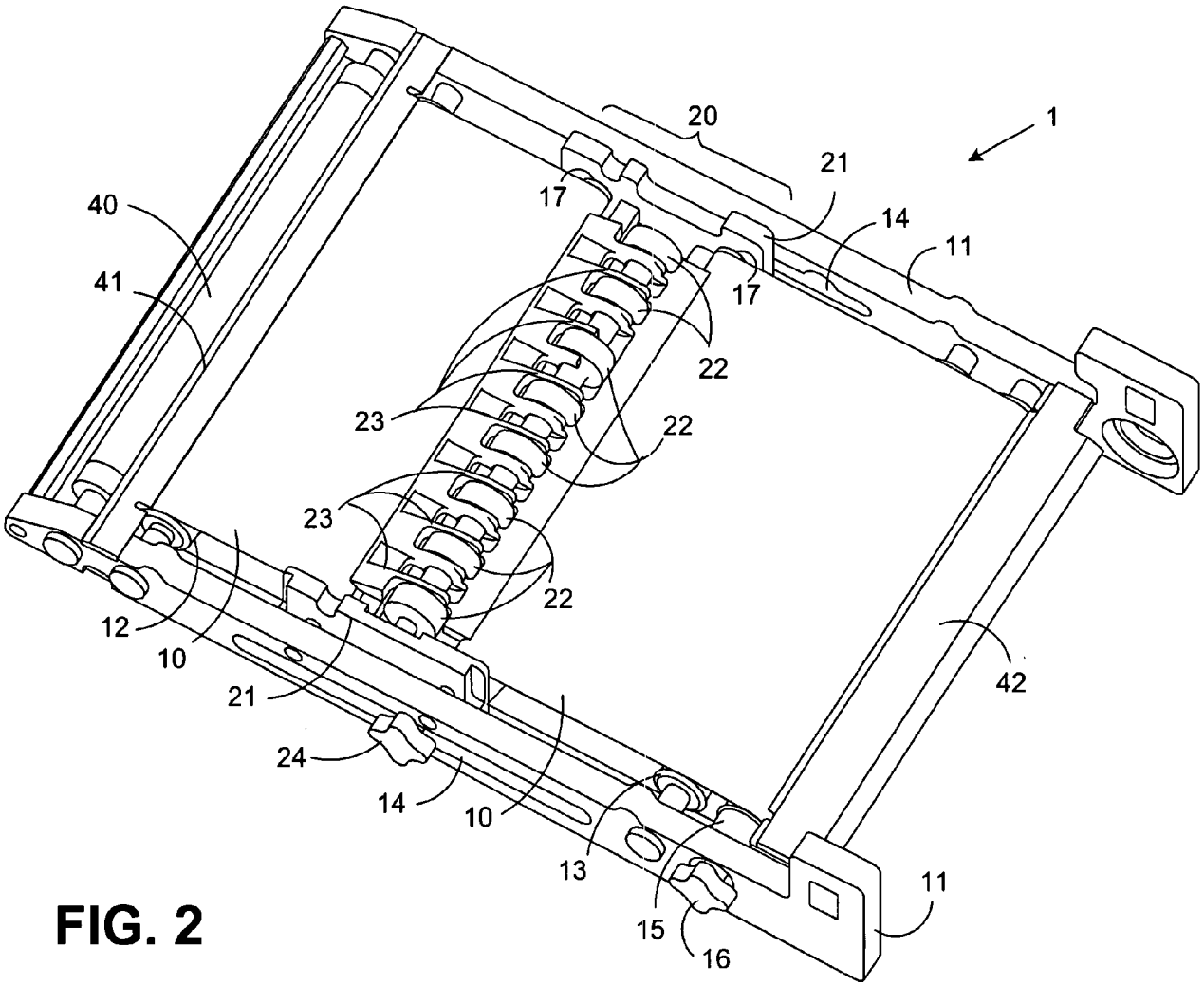
FIG. 2 depicts an isometric view of a lower assembly of an accumulator utilizing the present invention.
Figure 3:
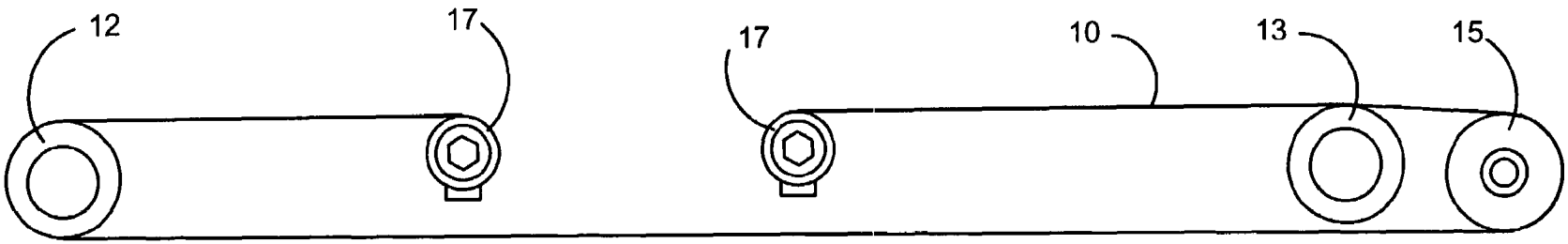
FIG. 3 depicts a side view of an adjustable paper path deck.
Figure 4:
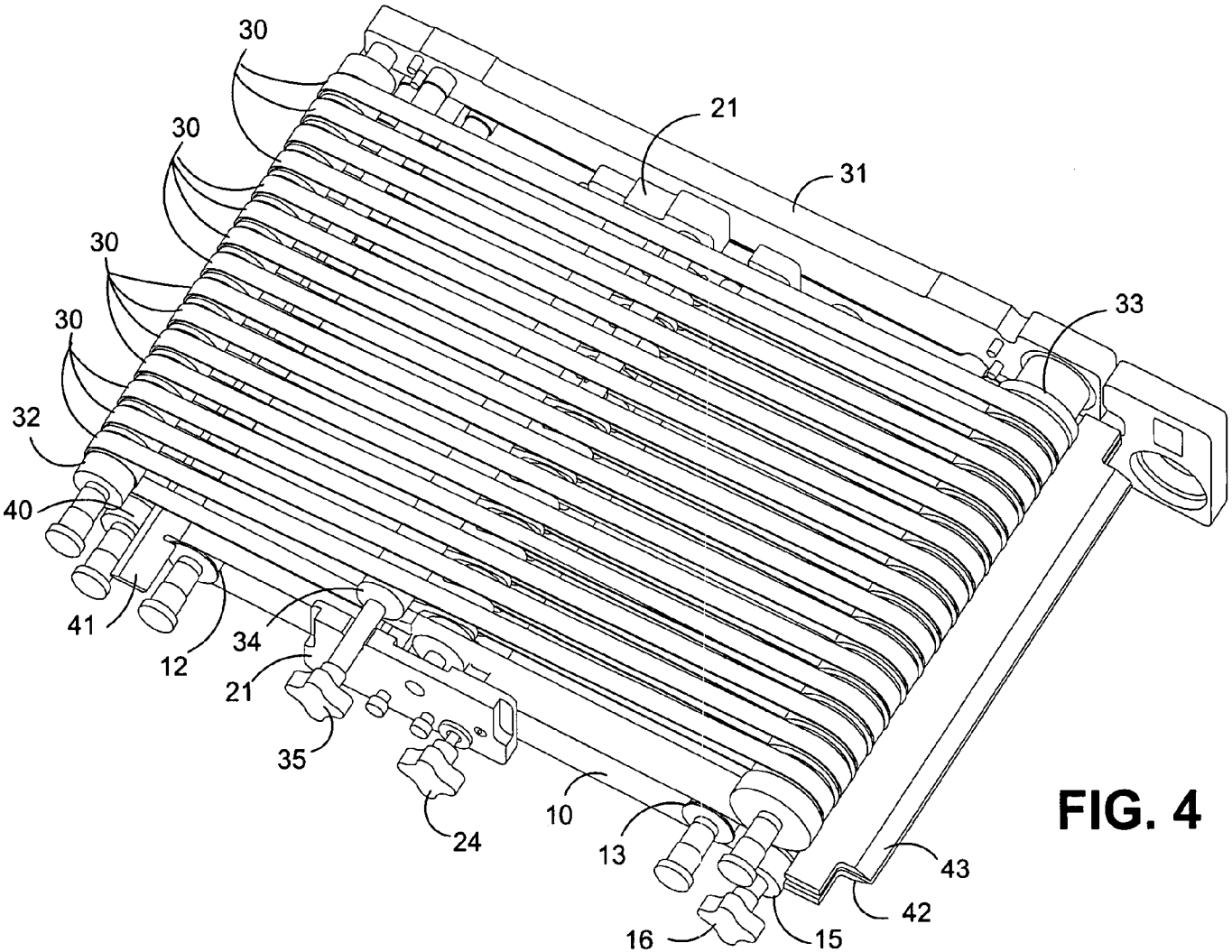
FIG. 4 depicts an isometric view of an accumulator with its upper assembly in place.
Figure 5:
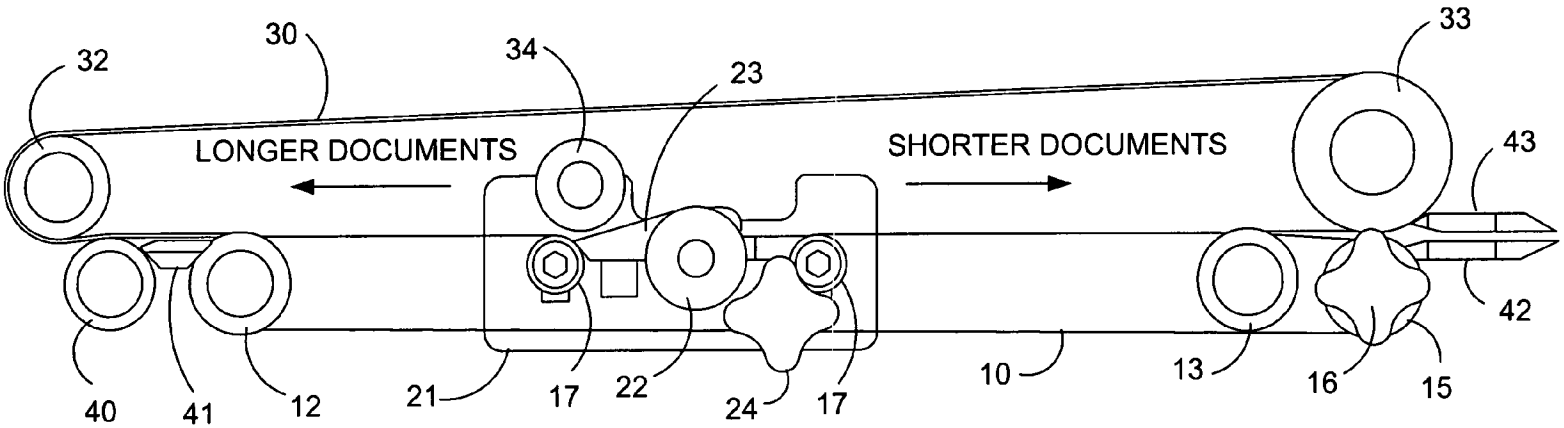
FIG. 5 depicts a side view of an accumulator using the adjustable paper path deck.

A preferred embodiment of the adjustable paper path guide deck can be seen in FIGS. 2-5. FIG. 2 depicts the paper path guide deck used in a lower assembly 1 of an accumulator apparatus. Further details of an accumulator apparatus that can use the adjustable paper path guide deck are included in copending application publication number 2006/0056953, titled High Throughput Sheet Accumulator, filed concurrently herewith, and incorporated by reference in its entirety. Sheets are fed into the accumulator apparatus from an input roller 40 and over an input guide 41. Downstream of the input guide 41, a transported sheet is supported upon a flexible sheet 10. As seen in FIG. 4, transported sheets are driven from above by belts 30, while on the flexible sheet 10. Deck sheet 10 has a low coefficient of friction to allow paper to slide over it while being driven by belts 30 from above.

Preferably, as seen in FIG. 2 and the side view in FIG. 3, the flexible sheet 10 is a thin sheet non-permanently deforming material. The sheet 10 is wrapped around an upstream support roller 12 and a downstream support roller 15. In the preferred embodiment, the sheet 10 does not form a continuous loop and the ends of the sheet 10 are fixed around clamping bars 17 on an upper reach of the sheet wrapped around the rollers. The clamping bars 17 are coupled to a sheet-manipulating device, the position of which can be adjusted in an upstream or downstream direction by moving the sheet 10 around the rollers.

In an alternate embodiment, deck sheet 10 is comprised of a continuous belt loop wrapped around the rollers 12 and 15. In that embodiment, no clamping bars 17 are needed, and the sheet manipulating device is coupled to the continuous sheet loop 10.

Returning to the preferred embodiment, the sheet-manipulating device, positionable by virtue of the moving sheet 10, is an accumulator ramp apparatus 20. Sheets are driven over the ramp apparatus 20 and are deposited in an accumulation region on deck sheet 10 of the accumulator. In the preferred embodiment, the ramp apparatus 20 includes rollers 22 operating in cooperation with ramp structures 23 to raise sheets above the level of the deck sheet 10 and to deposit the raised sheet on top of any previously deposited sheets downstream of the ramp apparatus 20.

In the preferred embodiment the ramp apparatus 20 and the clamping bars 17 are mutually supported on moving side frames 21 on both lateral sides of the ramp 20. The moving side frames 21 are supported in slots 14 in lower side support members 11.

During normal operation sheet 10 remains stationary and does not move around the rollers 12 and 15. Likewise the ramp apparatus 20 and moving side frame 21 coupled between the ends of the sheet 10 remain stationary. However, for an accumulator, or other type of sheet manipulating device, to operate on different sized sheets, it may become necessary to adjust the positions of those components. In the preferred embodiment, the ramp apparatus 20 must be moved in an upstream direction in order to make more room for storing longer sheets in the accumulation region of sheet 10 downstream of the ramp apparatus 20. Conversely, for smaller sheets the ramp apparatus 20 would be moved in the downstream direction, while simultaneously shortening the region of sheet 10 that is downstream of the ramp apparatus 20. For the preferred application, the adjustable deck is adjustable to accommodate sheets from seven inches to fourteen inches long, resulting in at least a seven inch range of adjustability.

In the preferred embodiment a threaded locking knob 24 is tightened via a threaded rod member potion of side frame 21 to hold the side frame 21 in place during normal operation. The threaded rod member portion of side frame 21 is slidably supported in slots 14. To make an adjustment for different sized sheets, the locking knob 24 would be loosened, allowing the side frames 21 to move in the upstream and downstream directions along the slots 14. As the side frames 21 and ramp apparatus 20 were moved in the upstream and downstream directions, the deck sheet 10 moves around rollers 12 and 15, allowing more or less deck to be provided for supporting the sheets, as needed.

In the preferred embodiment, the adjustment of the flexible sheet 10 is achieved by rotating the roller 15 using adjustment knob 16 coupled thereto. Once adjustment knob 16 has been turned to adjust the accumulator ramp 20 and deck sheet 10 to their proper positions, locking knob 24 is tightened to hold the adjustable components in place. Preferably, rollers 12 and 15 incorporate ball-bearings, or other means to maintain smooth rolling action under load, to make adjustments easy.

In an alternative embodiment, rollers 12 and 15 may be turn-bars that do not rotate themselves, but that have sufficiently low friction that the sheet 10 can be bent and rotated around their surfaces when adjustments are being made. In any embodiment, a minimum radius of the rollers is determined by the choice of material for deck sheet 10, so that the deck sheet will not deform permanently.

The means for driving sheets through the accumulator are shown in FIG. 4. Overhead belts 30 are positioned above the deck sheet 10 and ramp apparatus 20, providing a driving force to slide sheets over the deck and ramp. The belts 30 are supported on rollers 32 and 33, and are downwardly biased to provide a normal force so that the friction of the belts 30 can drive paper sheets downstream. Also, hold-down roller 34, supported on the movable side frame 21 ensures that a sufficient normal force is applied downwardly on the belts 30 while driving sheets over the ramp 23 and ramp rollers 22. The belt rollers 33 and 34 are preferably supported on upper side support members 31 positioned above lower side support members 11. At a downstream end of the accumulator apparatus, output guides 42 and 43 guide accumulations downstream of the adjustable portion of the accumulator.

As seen in FIGS. 2-5, a third deck roller 13 may be positioned between the primary deck rollers 12 and 15. The top of this third roller 13 is positioned to intersect and lift the top plane of the sheet 10 between the roller 12 and 15. This lifting provides a slope to the deck at a downstream end of the accumulator. This slope can serve to keep the belts 30 firmly pressed against the sheets on the upstream part of the slope, while opening some space for sheets, and reducing friction on sheets on the downstream portion of the slope.

Figure 6:
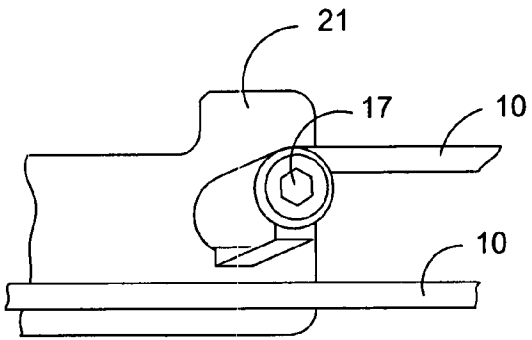
FIG. 6 depicts a tensioning mechanism for the adjustable paper path deck.

FIG. 6 depicts the preferred embodiment for tensioning the sheet 10 around the rollers 12 and 15. In this preferred embodiment, the sheet 10 is secured to the movable side frame 21 by clamping bars 17. Sheet 10 is wrapped around the clamping bar 17 and is tightened to provide the desired tension on the deck sheet 10. As the clamping bar 17 is rotated, tension is developed in the deck, making it flat and rigid. As discussed previously, two clamping bars 17 are used and locked in place (after tensioning) to movable side frames 21, which move as the deck is adjusted.

In the preferred embodiment, the material for sheet 10 is a thin sheet of stainless steel shim stock of 0.005 inches thick. Alternatively, the sheet 10 may be comprised of any metal or synthetic material that provides sufficient stiffness to serve as a guide deck, while having the flexibility to be wrapped around the rollers 12 and 15 without being permanently deformed. This preferred material is also corrosion resistant, wear resistant, and has the ability to be tensioned and wrapped around small pulleys without permanent deforming.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A paper processing device having a paper path with an input end and an output end, comprising:

an adjustable paper path guide deck apparatus, comprising:

a first roller proximal to the input end;

a second roller proximal to the output end; and a flexible sheet of non-permanently deforming material wrapped around the first and second rollers, a surface of the sheet forming a guide deck comprising a portion of the paper path, the guide deck being stationary during processing of paper and movable along a paper path direction while moving the flexible sheet around the first and second rollers during adjustment of the flexible sheet;

a locking mechanism coupled to the adjustable paper path guide deck apparatus for preventing the flexible sheet from moving around the first and second rollers when in a locked position, and allowing movement of the flexible sheet around the first and second rollers when in an unlocked position; and a sheet manipulating device in the paper path and coupled to the flexible sheet, whereby a position of the sheet manipulating device between the input end and the output end of the paper path is adjustable by moving the flexible sheet around the first and second rollers, wherein the sheet manipulating device comprises a sheet accumulator having a ramp for allowing subsequent sheets to be stacked on top of one another downstream of the ramp.

2. The paper processing device of claim 1 wherein the sheet manipulating device is movable towards the output end for handling short sheets, and away from the output end for long sheets.

3. The paper processing device of claim 1 wherein the adjustable paper path guide deck apparatus further comprises a tensioner mechanism for tensioning the flexible sheet between the first and second rollers.

4. The paper processing device of claim 1 wherein the flexible sheet is comprised of a sheet having two ends and the sheet manipulating device is coupled between the two ends, thereby making the sheet manipulating device adjustably positionable between the first and second rollers.

5. The paper processing device of claim 4 wherein the adjustable paper path guide deck apparatus further comprises a tensioner mechanism for tensioning the flexible sheet between the first and second rollers.

6. The paper processing device of claim 5 wherein the tensioner mechanism is comprised of a coupling between an end of the flexible sheet and the sheet manipulating device, the coupling comprising a clamping bar around which the flexible sheet is wrapped when the clamping bar is rotated.

7. The paper processing device of claim 1 wherein the paper processing device further comprises a support frame supporting the first and second rollers, and wherein the sheet manipulating device is movably coupled to and supported by the support frame.

8. The paper processing device of claim 7 wherein the locking mechanism comprises a sliding locking coupling between the sheet manipulating device and the support frame.

9. The paper processing device of claim 8 wherein the support frame includes slotted side members through which a rod member of the sliding locking coupling is adjustably movable along the paper path direction to adjust a position of the sheet manipulating device between the first and second rollers.

10. The paper processing device of claim 9 wherein the sliding locking coupling includes a screw locking mechanism to tighten the rod member to the support frame to prevent the sheet manipulating device from moving when in the locked position.

11. The paper processing station of claim 1 wherein the adjustable paper path guide deck apparatus further comprises a tensioner mechanism for tensioning the flexible sheet between the first and second rollers.

12. The paper processing station of claim 11 wherein the tensioner mechanism is comprised of a clamping bar around which the flexible sheet is wrapped when the clamping bar is rotated.

13. The paper processing station of claim 11 wherein the tensioner mechanism is comprised of a mechanism for adjusting a distance between the first and second rollers around which the flexible sheet is wrapped.

14. The paper processing station of claim 1 wherein the flexible sheet is comprised of fully hardened stainless steel shim stock.

15. The paper processing station of claim 14 wherein the flexible sheet is 0.005 inches thick.

16. The paper processing station of claim 1 further comprising a third roller positioned between the first and second rollers, at least part of a circumference of the third roller intersecting with a plane of the guide deck between the first and second rollers, thereby causing the guide deck to have a sloped profile on either side of the third roller.

17. The paper processing station of claim 16 wherein the third roller is positioned proximal to the output end of the paper path.

18. A paper processing device having a paper path with an input end and an output end, comprising:

an adjustable paper path guide deck apparatus, comprising:

a first roller proximal to the input end;

a second roller proximal to the output end; and a flexible sheet of non-permanently deforming material wrapped around the first and second rollers, a surface of the sheet forming a guide deck comprising a portion of the paper path, the guide deck being movable along a paper path direction while moving the flexible sheet around the first and second rollers;

a locking mechanism coupled to the adjustable paper path guide deck apparatus for preventing the flexible sheet from moving around the first and second rollers during processing of paper, and allowing movement of the flexible sheet around the first and second rollers during adjustment of the flexible sheet; and a sheet manipulating device in the paper path and coupled to the flexible sheet, whereby a position of the sheet manipulating device between the input end and the output end of the paper path is adjustable by moving the flexible sheet around the first and second rollers, wherein the sheet manipulating device comprises a sheet accumulator having a ramp for allowing subsequent sheets to be stacked on top of one another downstream of the ramp.

* * * * *